US005743624A

United States Patent [19]

Chiang

[11] Patent Number: 5,743,624

[45] Date of Patent: Apr. 28, 1998

[54] TORCH WITH A BELLOWED INTERMEDIATE FLEXIBLE TUBE MEMBER

[76] Inventor: Hanh Chiang, No. 162, Chung-Chen S. Rd., Hsia-Jing Hsiang, Tainan Hsien, Taiwan

[21] Appl. No.: 823,838

[22] Filed: Mar. 25, 1997

[51] Int. Cl.[6] ..... F21L 7/00

[52] U.S. Cl. ..... 362/198; 362/202

[58] Field of Search ..... 362/197, 198, 362/194, 202, 205, 208, 275, 427

[56] References Cited

U.S. PATENT DOCUMENTS

| | | | |
|---|---|---|---|
| 3,103,723 | 9/1963 | Becker | 362/198 |
| 4,733,337 | 3/1988 | Bieberstain | 362/202 |
| 5,570,949 | 11/1996 | Chiang | 362/198 |
| 5,571,278 | 11/1996 | Chiang | 362/198 |

*Primary Examiner*—Y. My Quach
*Attorney, Agent, or Firm*—Foley & Lardner

[57] ABSTRACT

A torch includes a head member with a bulb unit, a tail member with a cell unit, and a bellowed intermediate flexible tube member connected to the head and tail members. The tube member includes a tube body, two connectors respectively attached to two ends of the tube body and having internally threaded end sections which engages the end sections of the head and tail members, and front and rear conductive contact sets respectively provided in the connectors in such a manner that the front conductive set is in electrical contact with the bulb unit while the rear conductive set is in electrical contact with the cell unit. Each of the front and rear conductive sets includes an insulated tubular seat fixed within a corresponding one of the connectors and provided with a reduced-diameter outer end portion, and an annular conductive ring sleeved around the outer end portion and provided with an externally toothed portion for engaging an inner surface of the corresponding connector so as to prevent disengagement therefrom. The tail member includes a cell-holding conductive barrel tube for accommodation of the cell unit therein, and a conductive cap which is detachably attached to the conductive barrel tube and which biases the cell unit to contact the contact element while the conductive barrel tube contacts the ring.

1 Claim, 6 Drawing Sheets

TORCH WITH A BELLOWED INTERMEDIATE FLEXIBLE TUBE MEMBER

BACKGROUND OF THE INVENTION

1. Field Of The Invention

The invention relates to a torch with a bellowed intermediate flexible tube member, wherein the bellowed intermediate flexible tube member is provided with fixed electrical contacts such that disengagement thereof with the head and tail members of the torch does not occur.

2. Description Of The Related Art

FIGS. 1 to 3 illustrate a torch 10 according to U.S. Pat. No. 5,570,949. As shown, the torch 10 includes a head member 17 with a bulb unit, a tail member 18 with a cell unit, and a bellowed intermediate flexible tube member 11 connected threadedly to the head and tail members 17, 18. The head member 17 includes an on-off switch 170 for energizing the bulb unit upon actuation. The tube member 11 includes a tube body 110, two connectors 12 respectively attached to two ends of the tube body 110, and front and rear conductive contact sets respectively provided in the connectors 12 in such a manner that the front contact set is in electrical contact with the bulb unit while the rear contact set is in electrical contact with terminals of the cell unit. Each of the front and rear conductive sets includes an insulated tubular seat 13 fixed within the corresponding connector 12 and provided with a reduced-diameter outer end portion 133, an annular conductive ring 15 sleeved around the outer end portion 133, and a conductive mushroom-like contact element 14 press-fitted within the opening 131 of the outer end portion 133 in the seat 12. A central wire 161 extends through the tube body 110 and the corresponding seat 12 and has a first end extended into the blind holes 143 of the corresponding contact element 14 so as to establish electrical connection. A peripheral wire 16 extends through the tube body 110 and the seat 12 for electrical contact with the ring 15. The ring 15 and the contact element 14 serve as two electrical contacts.

Some drawbacks of the aforementioned torch are as follows:

(I) Because the conductive ring 15 is sleeved around the reduced-diameter outer end portion 133 of the seat 13 without any securing means, the former may disengage from the latter, thereby resulting in electrical disconnection between the head and tail members 17, 18 of the torch 10.

(II) It is both time-consuming and laborious to form an elongated conductive stick in the tail member 18. The stick has one end 183 exposed outwardly of the tail member 18 in order to serve as a terminal for electrical contact with the ring 15. Displacement of the ring 15 relative to the seat 13 may result in disengagement between the end 183 and the ring 15.

SUMMARY OF THE INVENTION

The object of this invention is to provide a torch with a bellowed intermediate flexible tube member, wherein the bellowed intermediate flexible tube member has fixed electrical contacts such that untimely electrical disengagement between the head and tail members of the torch can be avoided.

The torch of the present invention includes a head member with a bulb unit, a tail member with a cell unit, and a bellowed intermediate flexible tube member threadedly connected to the head and tail members. The tube member includes a tube body, two-connectors respectively attached to two ends of the tube body and respectively have internally threaded end sections engaging the threaded end sections of the head and tail members, and front and rear conductive contact sets respectively provided in the connectors in such a manner that the front conductive set is in electrical contact with the bulb unit while the rear conductive set is in electrical contact with terminals of the cell unit. Each of the front and rear conductive sets includes an insulated tubular seat fixed within a corresponding one of the connectors and provided with a reduced-diameter outer end portion, an annular conductive ring sleeved around the outer end portion, an opening formed in the outer end portion of the seat, and a conductive mushroom-like contact element which is press-fitted within the outer end portion of the seat and which has a small-diameter portion that extends into the outer end portion of the seat and a large-diameter outer end portion that is exposed partially to an exterior of the seat. A central wire extends through the tube body and the opening of the seat, and has a first end attached to the small-diameter portion of the contact element so as to establish electrical connection. A peripheral wire extends through the tube body and the seat for electrical contact with an inner peripheral surface of the ring.

Each of the rings is flexible and has an externally toothed portion which extends radially and outwardly from an outer surface thereof and which engages an inner surface of the corresponding connector so as to prevent disengagement therefrom. The position of the ring relative to the seat is therefore secured. The tail member includes a cell-holding conductive barrel tube for accommodation of the cell unit therein, and a conductive cap which is detachably attached to the conductive barrel tube and which biases the cell unit to contact the contact element while the conductive barrel tube contacts the ring.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENT

Since this invention is related to an improvement of the flexible tube member employed in the torch that is disclosed in U.S. Pat. No. 5,570,949, only the characterizing parts thereof will be described in this specification.

Figure 1:
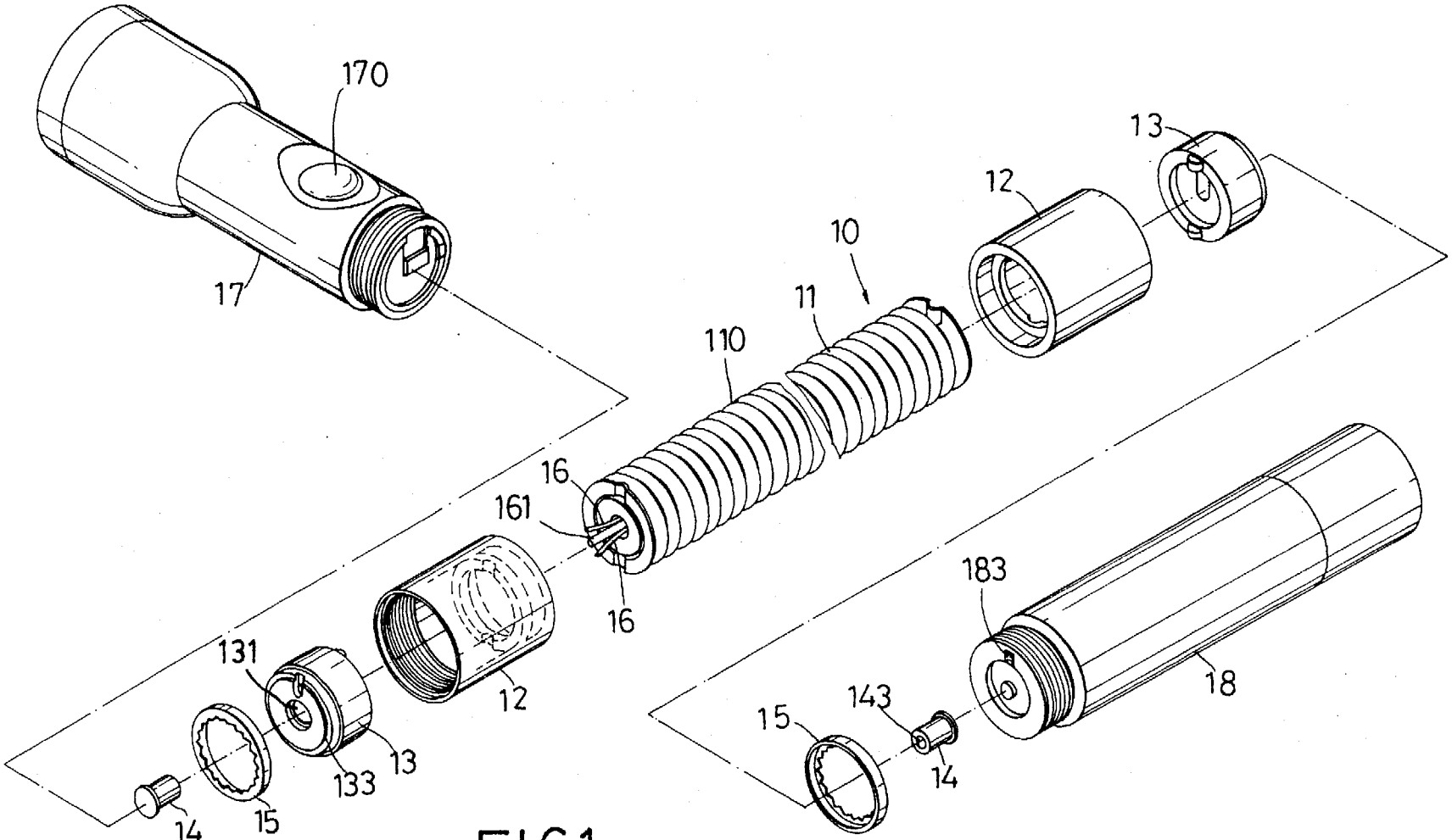
FIG.1 PRIOR ART
FIG. 1 is an exploded view of a torch according to U.S. Pat. No. 5,570,949.
Figure 2:
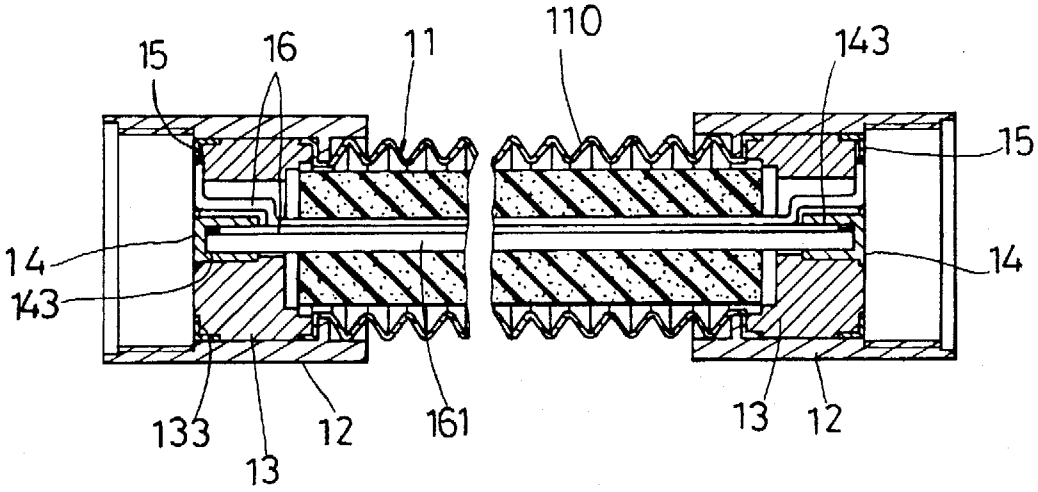
FIG.2 PRIOR ART
FIG. 2 is a partly sectioned view of a flexible tube member employed in the torch according to U.S. Pat. No. 5,570,949.
Figure 3:
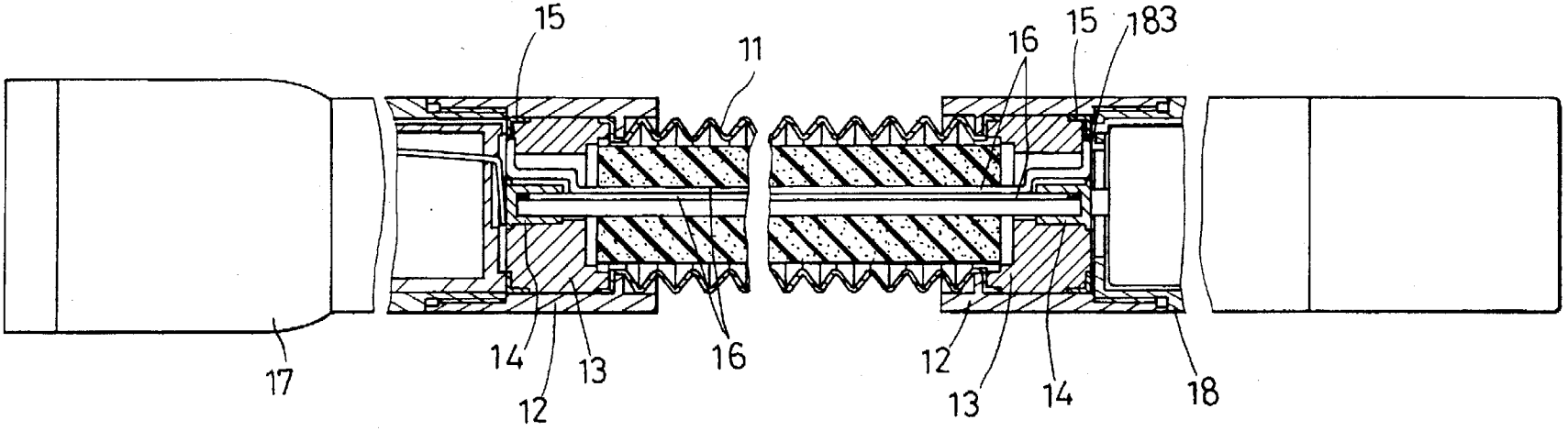
FIG. 3 PRIOR ART
FIG. 3 is a partly sectioned view of a portion of the torch according to U.S. Pat. No. 5,570,949.
Figure 4:
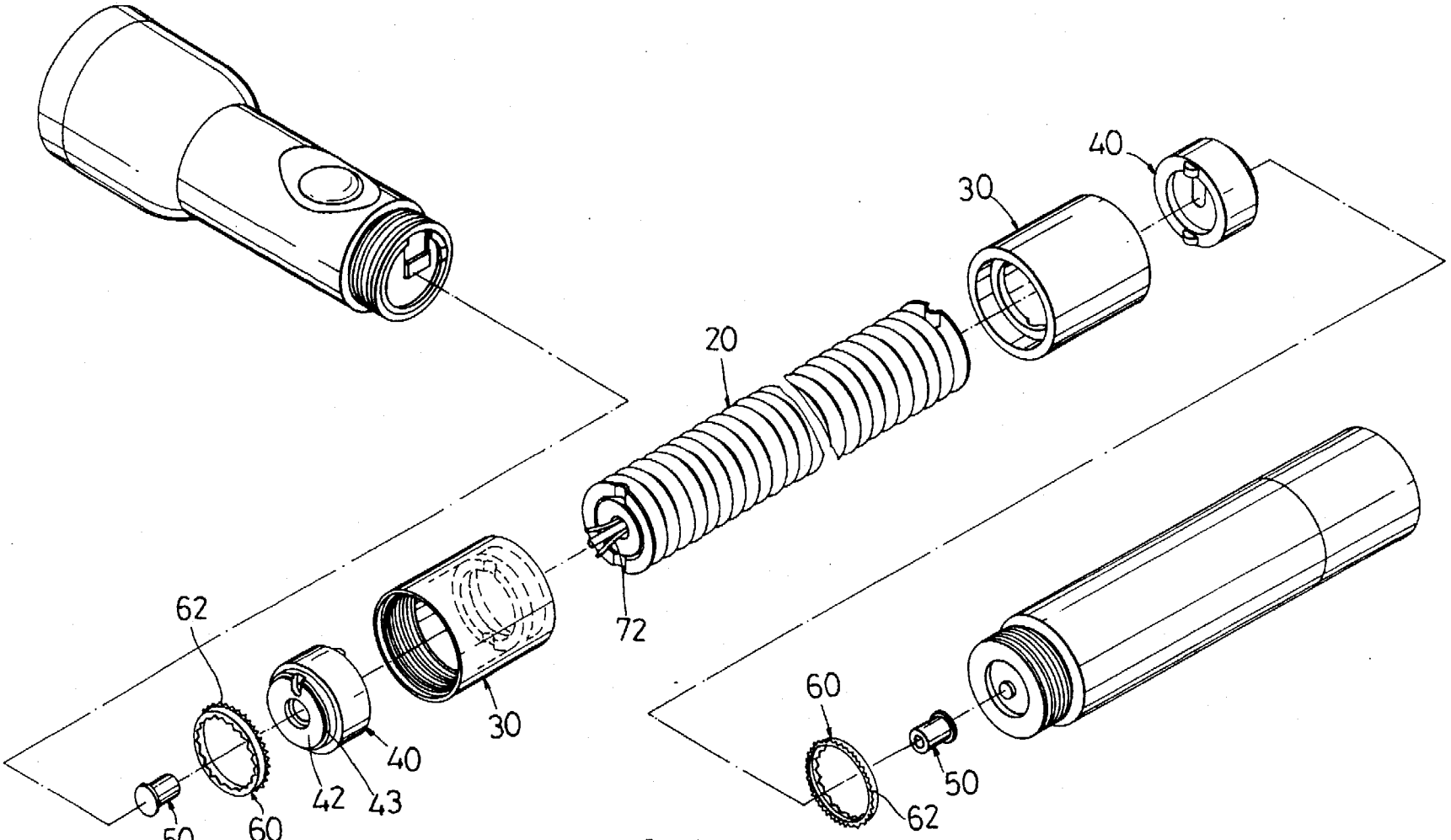
FIG. 4 is an exploded view of a torch of this invention.
Figure 5:
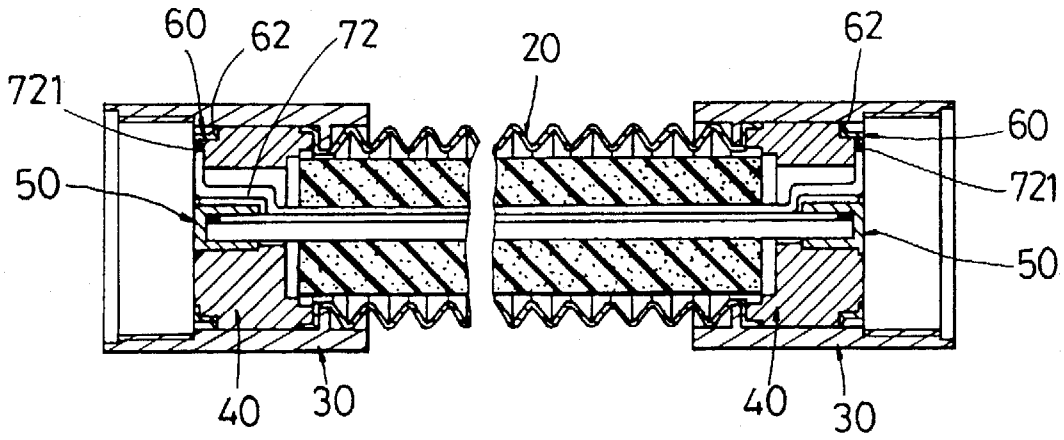
FIG. 5 is a partly sectioned view of a flexible tube member employed in the torch of this invention.
Figure 6:
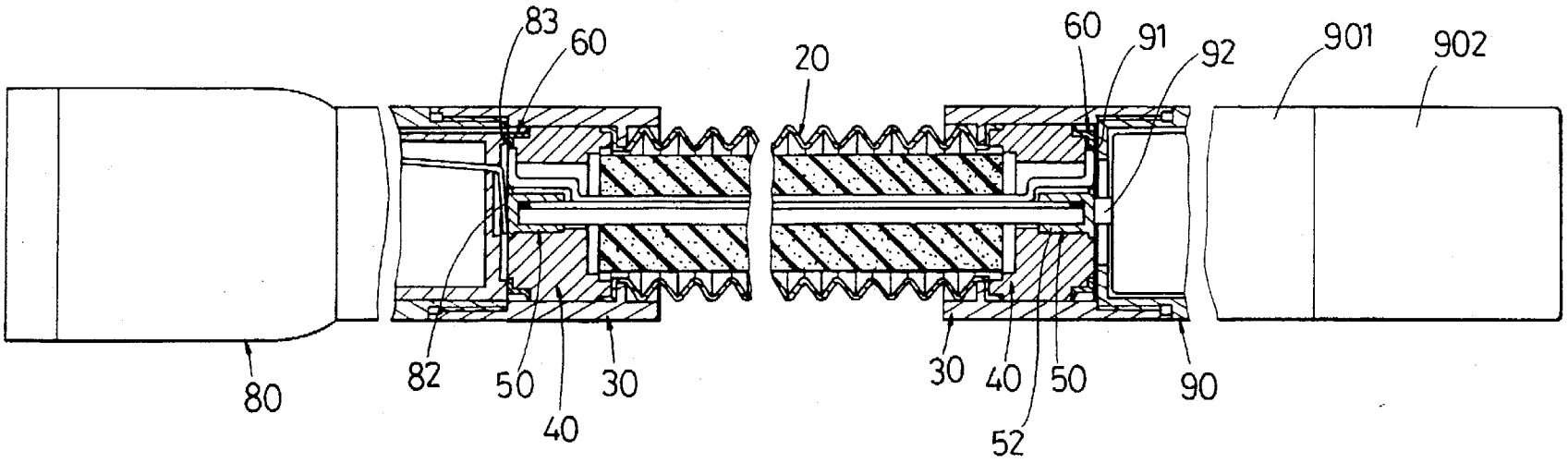
FIG. 6 is a partly sectioned view of a portion of the torch according to this invention.

As illustrated in FIGS. 4, 5 and 6, each of the conductive rings 60 is flexible and has an externally toothed portion 62 which extends radially and outwardly from an outer surface thereof. The ring 60 is sleeved around the reduced-diameter outer end portion 43 of the insulated tubular seat 40 which is later placed in the corresponding connector 30 of the tube member 20 in such a manner that the externally toothed portion 62 engages an inner surface of the connector 30 so as to prevent disengagement therefrom and consequently secures relative position of the ring 60 on the tubular seat 40. Thus, the end portion 721 of the peripheral wire 72 is secured to the inner peripheral surface of the ring 60 and disengagement between the wire 72 and the ring 60 is prevented.

The torch of this invention is shown partly in sectional view as illustrated in FIG. 6. The head member 80 includes a bulb unit which has first and second ends 82, 83 which contact the element 50 and the ring 60, respectively. The tail member 90 includes a cell-holding conductive barrel tube 901 which accommodates the cell unit 92 therein, and a conductive cap 902 which is detachably attached to the conductive barrel tube 901 and which biases the cell unit 92 to contact the contact element 50 while an end 91 of the conductive barrel tube 901 contacts the ring 60. Because the barrel tube 901 is conductive, the trouble of forming an elongated conductive stick in the tail member 90 as disclosed in U.S. Pat. No. 5,570,949 can be avoided.

With this invention thus explained, it is apparent that numerous modifications and variations can be made without departing from the scope and spirit of this invention. It is therefore intended that this invention be limited only as indicated in the appended claims.

I claim:

1. A torch comprising:

a head member with a bulb unit and having a threaded end section;

a tail member with a cell unit and having a threaded end section;

a bellowed intermediate flexible tube member including a tube body, two connectors respectively attached to two ends of the tube body and respectively having internally threaded end sections engaging said threaded end sections of the head and tail members, front and rear conductive contact sets respectively provided in the connectors in such a manner that the front conductive set is in electrical contact with the bulb unit while the rear conductive set is in electrical contact with terminals of the cell unit, wherein each of the front and rear conductive sets includes an insulated tubular seat fixed within a corresponding one of the connectors and provided with a reduced-diameter outer end portion, an annular conductive ring sleeved respectively around each of the outer end portions, an opening formed respectively in each of the outer end portions of the seat, a conductive mushroom-like contact element press-fitted respectively within each of the outer end portions of the seat and having a small-diameter portion which extends respectively into each of the outer end portions of each of the respective seats and a large-diameter outer end portion which is exposed partially to an exterior of each of the respective seats, a central wire extending through the tube body and each of the openings of the respective seats and having an end attached to each of the respective small-diameter portions of the contact element so as to establish electrical connection therebetween, and a peripheral wire extending through the tube body and each of the respective seats for electrical contact with an inner peripheral surface of each of the respective rings;

each of said rings being flexible and having an externally toothed portion which extends radially and outwardly from an outer surface thereof and which engages an inner surface of a corresponding one of said connectors so as to prevent disengagement therefrom and consequently securing relative position of the ring on said seat;

said tail member including a cell-holding conductive barrel tube for accommodating said cell unit therein and a conductive cap which is detachably attached to the conductive barrel tube and which biases the cell unit to contact one of said contact elements while said conductive barrel tube contacts one of said rings, and said bulb unit including a first end and a second end which contacts another of said contact elements and another of said rings, respectively.

* * * * *